US005678160A

United States Patent [19]

Williams

[11] Patent Number: 5,678,160

[45] Date of Patent: Oct. 14, 1997

[54] ENVELOPE PRINTING

[75] Inventor: George Thomas Williams, Georgetown, Ky.

[73] Assignee: Lexmark International, Inc., Lexington, Ky.

[21] Appl. No.: 586,350

[22] Filed: Jan. 16, 1996

[51] Int. Cl.[6] ..... G03G 15/00

[52] U.S. Cl. ..... 399/400; 399/381; 399/397

[58] Field of Search ..... 399/381, 397, 399/400, 330, 328; 219/216, 469; 430/126, 124

[56] References Cited

U.S. PATENT DOCUMENTS

| | | | |
|---|---|---|---|
| 4,753,543 | 6/1988 | Mochimaru et al. | 430/119 |
| 4,915,369 | 4/1990 | Rutishauser | 271/2 |
| 4,958,195 | 9/1990 | Firth, III et al. | 399/332 |
| 5,139,250 | 8/1992 | Zoltner | 271/2 |
| 5,149,076 | 9/1992 | Stenz | 271/2 |
| 5,268,727 | 12/1993 | Oleksa et al. . | |
| 5,295,674 | 3/1994 | Zoltner | 271/2 |
| 5,345,301 | 9/1994 | Satoh et al. | 399/328 |
| 5,549,290 | 8/1996 | Long et al. | 271/166 |

FOREIGN PATENT DOCUMENTS 5-8892 1/1993 Japan .

*Primary Examiner*—Matthew S. Smith
*Attorney, Agent, or Firm*—John A. Brady

[57] ABSTRACT

Envelopes (9) are fed flap first and flap closed long dimension first into the nip of fixing rollers (3,4). The fixing rollers are less wide than the envelopes, and the printing system does not print on the edge of the envelope which is not fixed.

Since this adds very little to the apparatus and software, wrinkle-free envelope printing is achieved at very low initial and overall cost.

1 Claim, 1 Drawing Sheet

ENVELOPE PRINTING

TECHNICAL FIELD

This invention relates to printers the operation of which includes a pressure and heat application to fix a power image by fusing. More specifically, this invention relates to printing envelopes with such a printer without wrinkling of the envelopes.

BACKGROUND OF THE INVENTION

Wrinkling of envelopes being printed upon has been a continuing problem when the printing involves fixing with heat in a nip between pressure rollers. Conventionally, envelopes have been fed short dimension first since printers have been designed to accommodate correspondence paper sizes, not the envelopes. Typical previous attempts to print envelopes without wrinkles have involved relieving the pressure on the envelopes at various places in the fixing operation. U.S. Pat. No. 5,268,726 to Oleksa et al is representative. A prior alternative is known in which the fixing rollers are separated for the last three inches of the envelope, requiring that the envelope be oriented such that there was no text in this area since it would not be fused.

DISCLOSURE OF THE INVENTION

In accordance with this invention envelopes are fed flap first and flap closed between the nip of fixing rollers. The rollers may be less wide than the envelopes with the restriction that printing is prevented at the edge or edges which extend past the rollers.

Since the fixing rollers need not be actually lengthened, this modification adds very little to the printer apparatus cost. With respect to software this invention is a simplification, since the lines printed correspond to lines which would be input from a conventional address list. Accordingly, wrinkle-free envelope printing is achieved at very low initial and overall cost.

BRIEF DESCRIPTION OF THE DRAWING

The details of this invention will be described in connection with the accompanying drawing, in which.

BEST MODE FOR CARRYING OUT THE INVENTION

Figure 1:
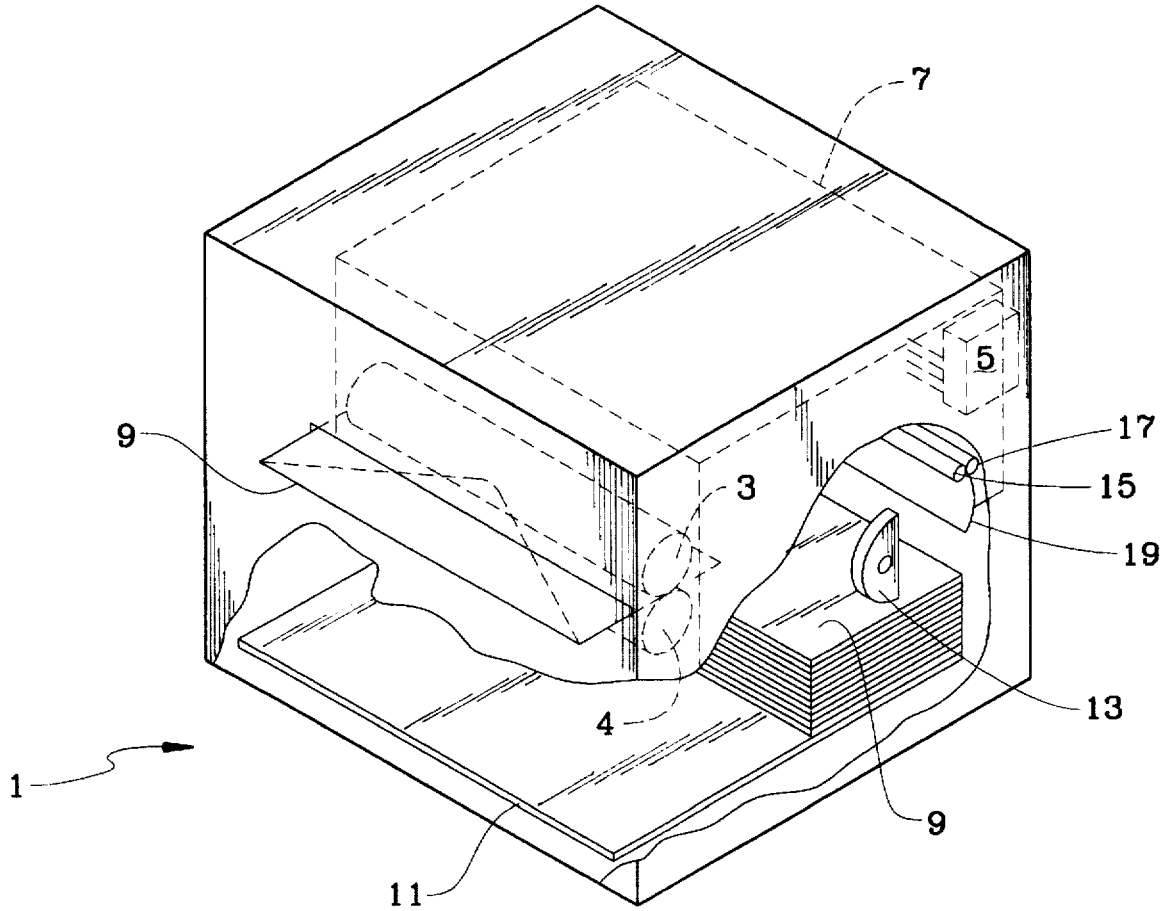
FIG. 1 is illustrative of the printer as a whole and FIG. 2 shows details of the fixing of an envelope entering the fixing rollers.

The fuser design used in the laser printer 1 of this invention is one in which one side of the medium being printed is against a reference edge in the printer. Contrary to previous printers, however; envelopes are fed with the short side parallel to the feed direction. The fixing station comprises a hot roller 3 and a backup roller 4, which form a nip receiving the media to be fixed.

Control is by a microprocessor 5, which is standard in electronic printers. Imaging apparatus 7 may be any system resulting in a toned image, for example that of a typical electrophotographic laser printer. More specifically, the printer 1 may preferably be, except as modified by this invention, the Optra (trademark) laser printer sold commercially by the assignee of this invention. The existing Optra printer feeds envelopes short side first and uses a smaller, envelope tray when feeding envelopes.

In accordance with this invention envelopes 9 are stacked in tray 11 for the printing of envelopes. Where letter correspondence is being printed tray 11 would have letter size paper which is less wide than the envelopes 9. Rollers 3 and 4 are not as wide as the envelopes 9 and the portion of printer 1 to the side of roller 3 and 4 is unobstructed for the free passage of envelopes 9.

In operation a conventional pick roller mechanism 13 pushes a single envelope 9 from the top of tray 11 toward pinch roller 15 and 17. Guide 19 directs the envelope 9 to pinch rollers 15 and 17 which are then continuously turning. Rollers 15 and 17 move the envelope 9 to imaging mechanism 7 which creates an image of loose toner on envelope 9. For the printing of envelopes, microprocessor 5 restricts printing from occurring in the 12.5 millimeters from the leftward edge in FIG. 1, which is that portion which will not be fixed by rollers 3 and 4. After such printing on envelope 9 the envelope 9 enters the nip of fixing rollers 3 and 4 as shown in FIG. 1, which rotate and apply pressure to envelope 9 to fuse the toned image into a cohesive, permanent image on envelope 9. Immediately subsequent to fixing the envelope 9 is conveyed out the printer 1 for access by an operator of the printer 1 as a finished document, as is conventional.

Figure 2:
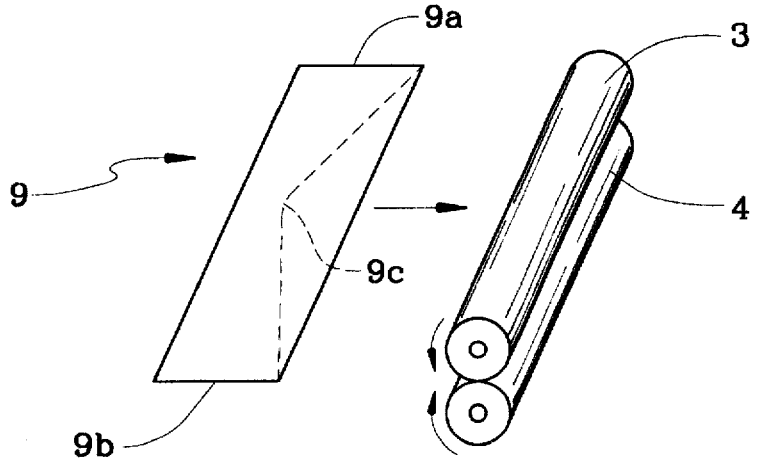

FIG. 2 illustrates the fixing step in more detail. Top roller 3 is the hot roller, typically heated by an internal quartz lamp (not shown). The paper feed direction is left to right in FIG. 2, and roller 3 therefore rotates counterclockwise as shown by the arrow. The bottom roller 4 is not a heated roller and is electrically grounded to reduce stray effects of the toner. The pressure between the rollers 3 and 4 on an envelope 9 may be up to at least 21 pounds per square inch. As shown in FIG. 2, the envelope 9 is wider than rollers 3 and 4 and enters the rollers with its top side **9*a* (conventionally used for a return address) under the rollers 3 and 4, and with the opposite side 9*b* having the last 12.5 mm to its edge not under rollers 3 and 4. The flap 9*c* of the envelop must be closed and lead into the nip of roller 3 and 4**.

Many existing fusers can be made to accommodate envelopes in accordance with this invention with only minor changes to the fuser frame. The length of the fixing rollers need not be changed. The region adjoining one end of the fixing rollers need only be cleared of obstructions to permit passage of 12.5 mm of the envelopes.

Use of this invention typically would be to print on envelopes of size up of the largest standard letter envelopes. Such envelopes have a long-side width of 250 millimeters (mm) in Europe and 241 mm in the United States. The largest standard correspondence paper in Europe is A4, which is 8¼ in. by 11¾ in. The paper would be fed with the 8¼ in. dimension first, which is 210 mm. The largest standard correspondence paper in the United States is 8½ in. by 11 in. The paper would be fed with 8½ in. dimension first, which is 216 mm. In accordance with this invention the fuser rollers 3 and 4 have an effective width of 216 mm, with typically about 4 mm additional on each side for structural purposes.

Other variations and alternatives will be apparent.

What is claimed is:

1. A printer capable of printing envelopes comprising an imaging system for applying images to media as loose toner, nip rollers having a heated roller for fixing said images, and means to feed envelopes from said imaging system into the nip of said nip rollers with the short dimension of said envelopes parallel to the direction of said feeding into said nip and with the flap of said envelopes leading and closed, said nip rollers being shorter in length than the long dimension of said envelopes.

* * * * *